US010556728B2

(12) United States Patent
Saito

(10) Patent No.: US 10,556,728 B2
(45) Date of Patent: Feb. 11, 2020

(54) PACKAGING CONTAINER

(71) Applicant: TOPPAN PRINTING CO., LTD., Tokyo (JP)

(72) Inventor: Takeshi Saito, Tokyo (JP)

(73) Assignee: TOPPAN PRINTING CO., LTD., Tokyo (JP)

( * ) Notice: Subject to any disclaimer, the term of this patent is extended or adjusted under 35 U.S.C. 154(b) by 0 days.

(21) Appl. No.: 15/685,217

(22) Filed: Aug. 24, 2017

(65) Prior Publication Data

US 2018/0002079 A1 Jan. 4, 2018

Related U.S. Application Data

(63) Continuation of application No. PCT/JP2016/001039, filed on Feb. 26, 2016.

(30) Foreign Application Priority Data

Feb. 26, 2015 (JP) ..... 2015-036158
Mar. 2, 2015 (JP) ..... 2015-040000

(51) Int. Cl.
*B65D 47/14* (2006.01)
*B65D 83/06* (2006.01)
(Continued)

(52) U.S. Cl.
CPC ..... *B65D 47/14* (2013.01); *B65D 77/2056* (2013.01); *B65D 77/2092* (2013.01);
(Continued)

(58) Field of Classification Search
CPC .... B65D 83/06; B65D 3/12; B65D 2231/007; B65D 25/42; B65D 3/14
(Continued)

(56) References Cited

U.S. PATENT DOCUMENTS 1,482,761 A * 2/1924 Moore ..... B65D 3/06 229/5.6
1,801,934 A * 4/1931 Pearson ..... B65F 1/02 210/464
(Continued)

FOREIGN PATENT DOCUMENTS

JP S57-134263 U 8/1982
JP 2001-158435 6/2001
(Continued)

OTHER PUBLICATIONS

International Search Report issued in International Patent Application PCT/JP2016/001039 dated May 24, 2016.
(Continued)

*Primary Examiner* — Shawn M Braden
(74) *Attorney, Agent, or Firm* — Foley & Lardner LLP

(57) ABSTRACT

In a packaging container in which a funnel-shaped spout is attached to a container body, positioning of a portion to which the funnel-shaped spout is attached is facilitated, and manufacturing costs are reduced. The packaging container includes: a container body having a body portion in which an engaging wall is provided, and a bottom portion provided at a first end of the body portion; a funnel part having a funnel shape within the body portion, and an wide opening end thereof is restricted from moving toward at least the first end by the engaging wall; and a sealing lid sealed to an opening portion which serves as the second end of the body portion while being in contact with a narrow opening end of the funnel part to seal the container body.

6 Claims, 13 Drawing Sheets

(51) Int. Cl.
*B65D 77/20* (2006.01)
*B65D 3/12* (2006.01)
*B65D 77/38* (2006.01)

(52) U.S. Cl.
CPC ..... *B65D 83/06* (2013.01); *B65D 3/12* (2013.01); *B65D 77/38* (2013.01)

(58) Field of Classification Search
USPC ..... 220/501
See application file for complete search history.

(56) References Cited

U.S. PATENT DOCUMENTS 2,595,103 A * 4/1952 Schmaling, Sr. ... A24F 19/0078 131/235.1
8,276,749 B1 * 10/2012 Schrauwen ..... A24F 19/0078 206/217
8,555,936 B2 * 10/2013 Gotoh ..... B65D 3/26 141/332
8,585,341 B1 * 11/2013 Oren ..... B65G 65/42 414/411
9,233,822 B2 * 1/2016 Messerschmid ..... B65D 3/04
2006/0086739 A1 * 4/2006 Woodhouse ..... A47G 7/07 220/501
2011/0036454 A1 * 2/2011 Saito ..... B65B 39/007 141/331
2011/0036868 A1 * 2/2011 Gotoh ..... B65D 3/26 141/351
2012/0055941 A1 * 3/2012 Messerschmid ..... B65D 3/04 220/694
2014/0238543 A1 * 8/2014 Terayama ..... B65D 77/2024 141/332
2014/0366490 A1 * 12/2014 Saito ..... B31F 1/0093 53/452

FOREIGN PATENT DOCUMENTS

JP 2009-280284 12/2009
JP 2010-254322 11/2010
JP 2011-201550 10/2011
JP 2013-220823 10/2013
JP 5365789 12/2013
JP 2014-001014 1/2014
JP 2014-069834 4/2014

OTHER PUBLICATIONS

Japanese Office Action dated Apr. 9, 2019 in corresponding application No. 2015-040000.

* cited by examiner

PACKAGING CONTAINER

CROSS-REFERENCE TO RELATED PATENT APPLICATIONS

This application is a continuation application filed under 35 U.S.C. § 111(a) claiming the benefit under 35 U.S.C. §§ 120 and 365(c) of International Application No. PCT/JP2016/001039, filed on Feb. 26, 2016, which is based upon and claims the benefit of priority of Japanese Patent Application No. 2015-036158, filed on Feb. 26, 2015, and Japanese Patent Application No. 2015-040000, filed on Mar. 2, 2015, the entireties of which are hereby incorporated by reference.

TECHNICAL FIELD

The present invention relates to a packaging container that facilitates transfer of fluid contents such as powdered, granular or liquid contents into other containers.

BACKGROUND

Packaging containers disclosed in PTLs 1 to 4 are known as packaging containers which facilitate refill of powdered or granular contents such as instant coffee into a storage container or a tank of a coffee machine. FIG. 10 shows a longitudinal sectional view of a packaging container 900 according to an example of such a packaging container. The packaging container 900 includes a cylindrical container body 920, a funnel part 930 fixed to an inner wall of the container body 920, and a sealing lid 960. The inside of the container body 920 is filled with contents 950 such as powders, and the opening portion of the container body 920 is sealed by the sealing lid 960. The sealing lid 960 has a lower layer film 961 and an upper layer film 962 which are removably laminated, and the lower layer film 961 includes cut lines which radially extend from the center of the lower layer film 961. The sealing lid 960 is sealed to the opening portion of the container body 920 in the state that it is in contact with a narrow opening end 931 of the funnel part.

When the contents 950 of the packaging container 900 are refilled into other containers, a tab 905 is pulled up to separate the upper layer film 962 from the lower layer film 961, and then the lower layer film 961 is pushed while being applied to the opening portion of a container to be refilled to break the lower layer film 961 along the cut lines. Accordingly, the contents 950 can be easily refilled into the container through the funnel part 930.

CITATION LIST

Patent Literature

PTL 1: JP-2009-280284 A
PTL 2: JP-2013-220823 A
PTL 3: JP-2014-1014 A
PTL 4: JP-5365789 B

SUMMARY OF THE INVENTION

Technical Problem

When manufacturing such a packaging container 900, the funnel part 930 is fixed to the container body 920 by, for example, inserting the funnel part 930 into the container body 920 for positioning, followed by high-frequency melting and bonding a portion where the inner wall of the container body 920 is in contact with the funnel part 930. Alternatively, the funnel part 930 is adhered and fixed to the container body 920 by being inserted into the container body 920 in the state that a portion of the inner wall of the container body 920 to which the funnel part 930 is to be fixed is heated and melted in advance.

However, since the container body 920 is in a straight shape having a uniform diameter, the funnel part 930 can be inserted into a position lower than a position to which the funnel part 930 is to be fixed. Hence, it is difficult to accurately insert the funnel part 930 to the position to which the funnel part 930 is to be fixed, and maintain the position until the funnel part 930 is fixed to the container body 920. Such a positioning with high accuracy requires a complex and expensive device and apparatus, thus resulting in high manufacturing cost.

An object of the present invention is to facilitate positioning of a portion to which a funnel-shaped spout is to be attached and reduce manufacturing costs for a packaging container in which the funnel-shaped spout is attached to the container body.

Solution to Problem

An aspect of the present invention is a packaging container including: a container body having a body portion provided with an engaging wall, and a bottom portion provided at the first end of the body portion; a funnel part having a funnel shape inserted into the body portion, and a wide opening end thereof is restricted from being moved toward at least the first end; and a sealing lid sealed to an opening portion which serves as a second end of the body portion while being in contact with a narrow opening end of the funnel part to seal the container body.

Advantageous Effects of the Invention

According to the present invention, in a packaging container in which a funnel-shaped spout is attached to the container body, positioning of a portion to which the funnel-shaped spout is to be attached is facilitated, and manufacturing costs are reduced.

DESCRIPTION OF REPRESENTATIVE EMBODIMENTS

Figure 1:
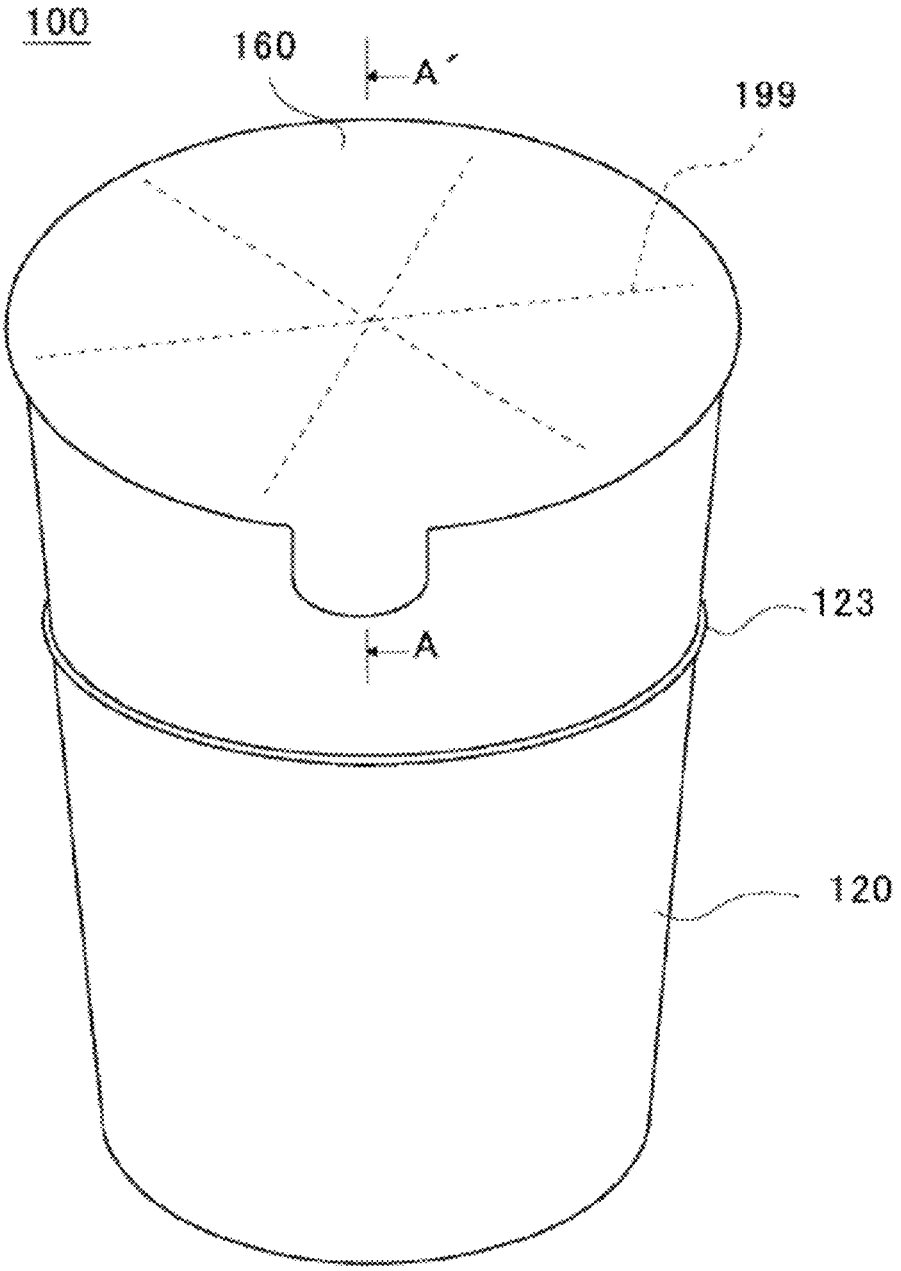
FIG. 1 is a perspective view of a packaging container according to a first embodiment of the present invention.

The preferred embodiments of the invention will be described below in detail with reference to the drawings. Note that, in the drawings, the same or equivalent components are represented by the same reference numerals, and overlapping descriptions will be omitted. Further, although the description has been made with reference to a limited number of embodiments, the scope of the invention is not limited thereto, and modifications of the above embodiments on the basis of the above disclosure is obvious to a person having ordinary skill in the art. That is, the present invention may not be limited to the aforementioned embodiments. Design modifications or the like can also be made to the above embodiments on the basis of a knowledge of a skilled person in the art, and such modifications or the like without departing from the principle of the present invention are encompassed within the scope of the present invention.

First Embodiment

Figure 2:
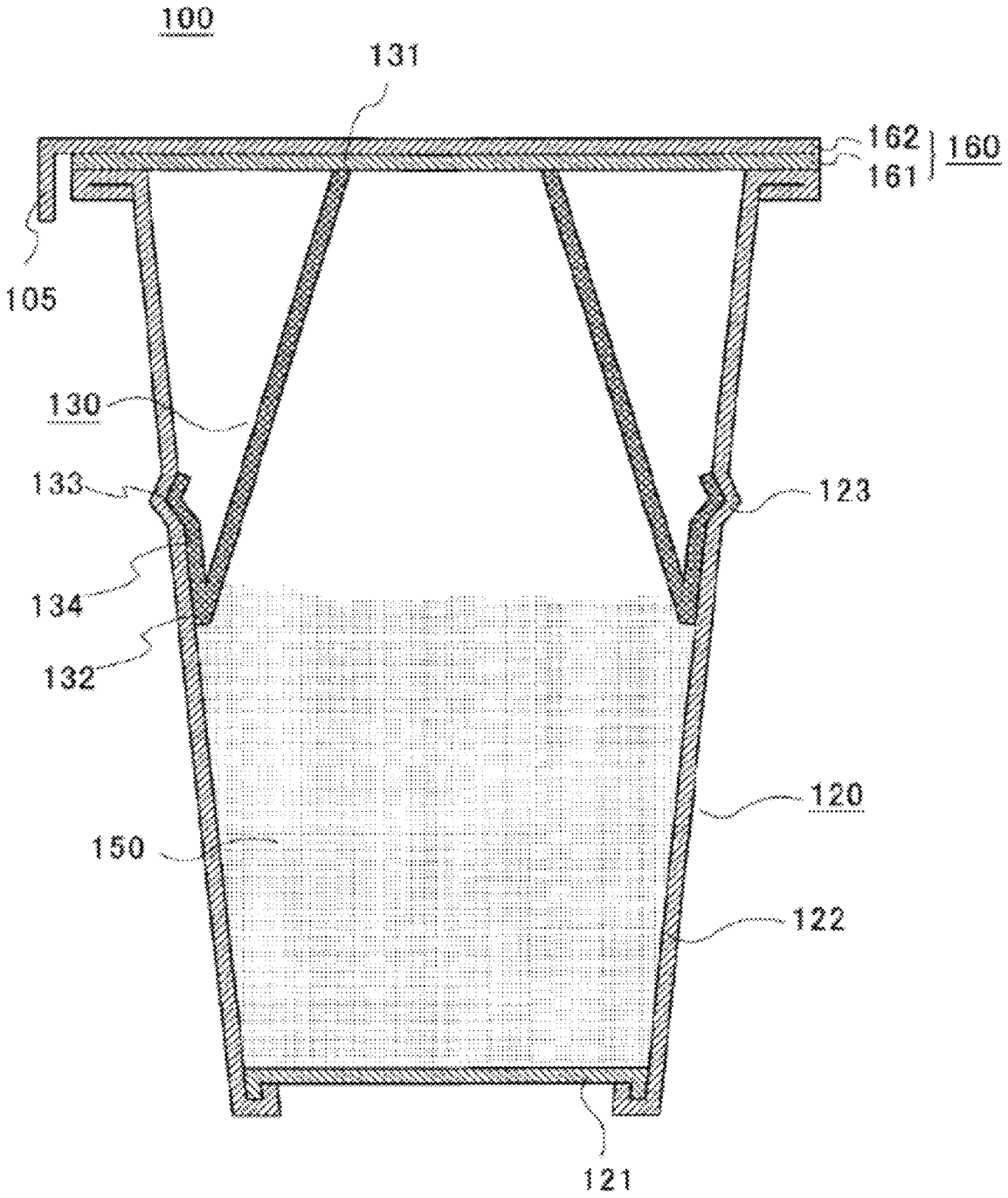
FIG. 2 is a longitudinal sectional view of the packaging container according to the first embodiment of the present invention.

Hereinafter, a first embodiment of the present invention will be described. FIG. 1 is a perspective view of a packaging container 100, and FIG. 2 is a longitudinal sectional view of the packaging container 100 taken along the line A-A' of FIG. 1. The packaging container 100 includes a cylindrical container body 120 having a bottom portion and an opening portion, a funnel part 130 and a sealing lid 160. Inside the container body 120 is filled with contents 150 such as powders, and the opening portion of the container body 120 is sealed by a sealing lid 160.

The container body 120 includes a bottom portion 121 and a body portion 122. The bottom portion 121 is attached to the first end of the body portion 122. The body portion 122 is in a tapered shape in which the diameter is gradually increased from the bottom portion 121 toward the second end which serves as an opening portion of the container body 120. On the body portion 122, an engaging groove 123 is projected outward, which structures a recessed portion in the body portion 122 is formed at a predetermined portion such that it surrounds the body portion 122.

The funnel part 130 is in a funnel shape having a narrow opening end and a wide opening end. The funnel part 130 has a wide opening end 132 in which an engaging portion 134 having a projection 133 projected outward is formed. The projection 133 is fitted into the engaging groove 123.

The sealing lid 160 includes a lower layer film 161 which is sealed to the opening portion of the container body 120, and an upper layer film 162 laminated on the outer surface of the lower layer film 161 such that it can be separated therefrom. The lower layer film 161 is provided with radial cut lines 199 such as a perforation, and are torn by being pushed by a container to be refilled when in use. The upper layer film 162 is provided to protect the cut lines 199 formed on the lower layer film 161, and to ensure the sealing ability of the packaging container 100, and is separated from the lower layer film 161 when in use. The upper layer film 162 is provided with a tab 105 at a portion of the outer peripheral edge so as to be easily held when being separated from the lower layer film 161.

The lower layer film 161 of the sealing lid 160 is welded with the narrow opening end 131 of the fennel part 130. They are preferably welded at a low adhesion strength such that it does not obstruct opening the packaging container 100 but does not allow the welding to break before opening the packaging container 100. The low adhesion strength is preferably lower than, for example, that of a portion where the lower layer film 161 of the sealing lid 160 is sealed with the opening portion of the container body 120. This welding can prevent the contents 150 from being moved from the inside to the outside of the funnel part 130 through the gap between the narrow opening end 131 and the lower layer film 160. Accordingly the contents 150 are prevented from being spilled out of the container to be refilled without entering the container during refilling, which will be described later. The narrow opening end 131 of the funnel part 130 may be in the same plane as the opening portion of the container body 120, or may be offset outward from the container body 120 and also from a plane which includes the opening portion to increase a contact pressure with the sealing lid 160.

When the contents 150 of the packaging container 100 are refilled, the upper layer film 162 is separated, and then the lower layer film 161 is pushed while being applied to the opening portion of a container to be refilled to thereby tear the lower layer film 161 along the cut lines 199 while breaking the welding between the lower layer film 161 and the narrow opening end 131 of the funnel part 130. Accordingly, the packaging container 100 is opened, and the contents 150 are funneled into the container to be refilled through the funnel part 130.

The materials of the container body 120 and the funnel part 130 are not limited. However, when using a laminated paper or plastic or the like, the funnel part 130 can be more firmly fixed to the body portion 122 by at least partially welding the engaging portion 134 with the engaging groove 123. The projection 133 of the engaging portion 134 may be fixed to the engaging groove 123 by inserting the funnel part 130 into the body portion 122 from the wide opening side in the state that the engaging portion 134 and the engaging groove 123 are heated in advance to be partially melted, and then engaging and adhering the projection 133 of the engaging portion 134 to the engaging groove 123. Alternatively, the projection 133 of the engaging portion 134 may be fixed to the engaging groove 123 by heating and the welding the engagement portion in the state that the projection 133 of the engaging portion 134 is engaged to the engaging groove 123. The method of heating is not limited. However, when the body portion 122 includes an aluminum foil as a barrier layer, for example, high frequency heating can be conducted after engagement. Further, the projection 133 of the engaging portion 134 may be fixed to the engaging groove 123 by not necessarily heating, or by using adhesive agents. Alternatively, the projection 133 of the engaging portion 134 may be fixed to the engaging groove 123 only by engagement of the engaging portion 134 and the engaging groove 123 without welding, adhering or the like.

According to the present embodiment, the engaging portion 134 is configured to be extended in a form of being outwardly folded back from the wide opening end 132 of the funnel part 130, and has a bending portion forming the projection 133 at the end thereof. The engaging portion 134 has a tapered portion forming the same tapered angle as that of the body portion 122 except for the projection 133, and is in surface contact with the body portion 122. The engagement between the projection 133 and the engaging groove 123, and the surface contact of the tapered portions, restricts the movement of the funnel part 130 toward the portion closer to the bottom portion 121 than to the portion to which the funnel part 130 is to be fixed, and thus facilitates positioning when the funnel part 130 is inserted into the body portion 122. Since the diameter of the opening portion of the body portion 122 is larger than the maximum diameter of the funnel part 130, the funnel part 130 is easily inserted to the fixing position. Therefore, high accuracy is not required for positioning or the like, thereby reducing costs for the machines required for manufacturing. Although the funnel part 130 is pushed toward the bottom portion 121 of the container body 120, the position thereof is hardly shifted during storing the packaging container 100, or refilling the contents. Accordingly, stable storage or refill can be achieved.

Contrary to the present embodiment, if the engaging groove is formed so as to be inwardly projected on the body portion 122, the projected portion of the groove might be crushed, which might cause impairing of the function of engaging when the funnel part 130 comes into contact with the engaging groove. Further, the engaging groove can be formed by, for example, pushing the rotating body against the body portion 122 so that the rotating body surrounds the body portion 122. However, the engaging groove can be more easily formed by attaching a female mold to the outer surface of the body portion 122, and pushing the rotating body from the inner surface of the body portion 122 to make the engaging groove outwardly projected on the body portion 122, rather than by attaching a male mold to the inner surface of the body portion 122, and pushing the rotating body from the outer surface of the body portion 122 to make the engaging groove inwardly projected on the body portion 122. Accordingly, as described above, it is preferred that the engaging groove 123 is formed so as to be projected outward on the body portion 122.

FIGS. 3A through 3D show modified examples of the shape of the funnel part 130. FIGS. 3A through 3D show a set of one of the two cross sections of the funnel parts according to modified examples, and each of the cross sections is symmetric with the surface passing through a center axis indicated by the dot-and-dash line. In the example shown in FIG. 3A, the projection 133 is formed in a shape in which it is outwardly bent at the wide opening end 132 of the funnel part 130, thereby constituting the entire engaging portion 134. In the example shown in FIG. 3B, the projection 133 is formed in a shape in which it is outwardly curled at the wide opening end 132 of the funnel part 130, thereby constituting the entire engaging portion 134. In the example shown in FIG. 3C, similar to the example shown in FIG. 3B, the projection 133 is formed in a shape in which it is outwardly curled at the wide opening end 132 of the funnel part 130, however, the taper of the funnel part 130 varies, thereby being in surface contact with the body portion 122 in the vicinity of the projection 133. The engaging portion 134 is constituted by this portion in surface contact with the body portion 122 and the projection 133.

Figure 3A:
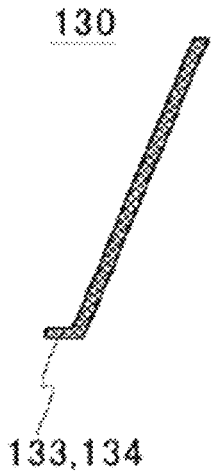
FIGS. 3A through 3D are a set of longitudinal sectional views of a funnel part according to the first embodiment of the present invention.
Figure 3B:
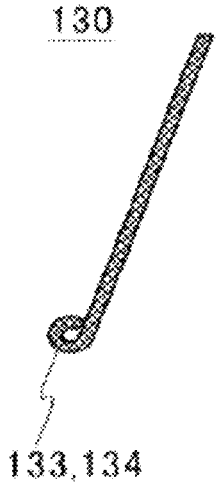
Figure 3C:
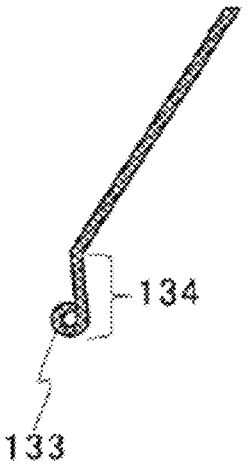
Figure 3D:
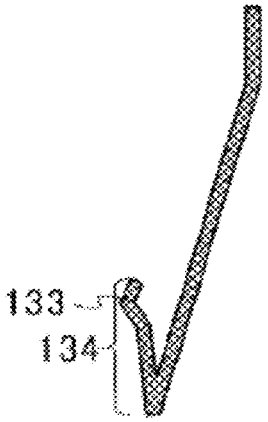

For the funnel part 130 shown in FIG. 2 and FIG. 3A, a plastic is preferably used in order to secure the strength of the portion where the wide opening end 132 is folded back. For the funnel part 130 shown in FIGS. 3B and 3C, a paper or a laminated paper is preferably used in order to facilitate forming the curled shape of the projection 133. These funnel parts may be appropriately modified considering, for example, how the lower layer film 161 is likely to be torn, or how the contents are likely to be funneled, when refiling the contents, described above. For instance, a certain portion including the narrow opening end of the funnel part may be in the straight shape having uniform diameter. The example of the funnel part 130 shown in FIG. 2 in which a portion closer to the narrow opening is in a straight shape is shown in FIG. 3D.

Figure 4:
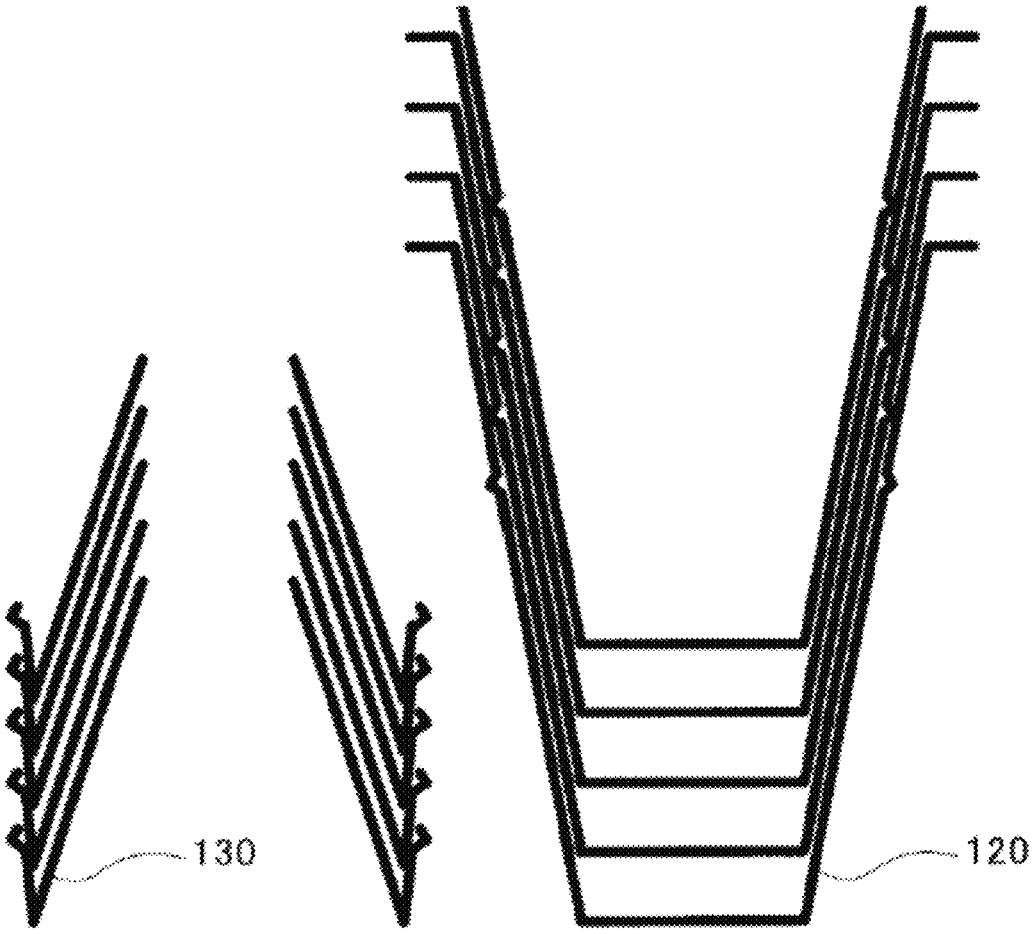
FIG. 4 is a longitudinal sectional view of the funnel part and a container body according to the first embodiment of the present invention, and the longitudinal sectional view illustrates that they are in a stored state.

As shown in a cross sectional view of FIG. 4, each of the funnel part 130 and the container body 120 can be stored and transported in a stacked state, before being fixed to each other, thereby reducing costs for storage and distribution.

The sealing lid 160 is a laminate of films or the like having polyethylene terephthalate and various barrier properties. The lower layer film 161 can be made of polyethylene, with an easy peel film or the like as the innermost layer which is the inner surface of the packaging container 100. When the funnel part 130 is made of a laminated paper in which resin such as polyethylene is laminated on paper, the lower layer film 161 is likely to separate from the funnel part 130 by peeling off the paper layer of the funnel part 130 during refill.

On the other hand, when various easy peel films are used as the innermost layer of the lower layer film 161, it was confirmed that the adhesion strength between the lower layer film 161 and the funnel part 130 becomes lower than that between the lower layer film 161 and the opening portion of the container body 120 by controlling the welding temperature, welding area or the like even if the funnel part 130 is any of a simple paper, a laminated paper, or a plastic. Accordingly, an easy peel film is preferably used as the innermost layer of the lower layer film 161 regardless of the material of the funnel part 130.

For example, the use of Lock & Peel (registered trademark) film manufactured by DuPont as the easy peel film allowed favorable opening of the container with an opening strength of 100 N (pushing force required for the lower layer film 160 to be separated from the funnel part 130 and to be torn) by conducting welding with the entire circumferences of the opening portion of the container body 120 at 200° C. for 1 second, and welding with the six points of the entire circumferences of the narrow opening end 131 of the plastic funnel part 130, each having a length of 1 mm, at 150° C. for 1 second.

Second Embodiment

Figure 5A:
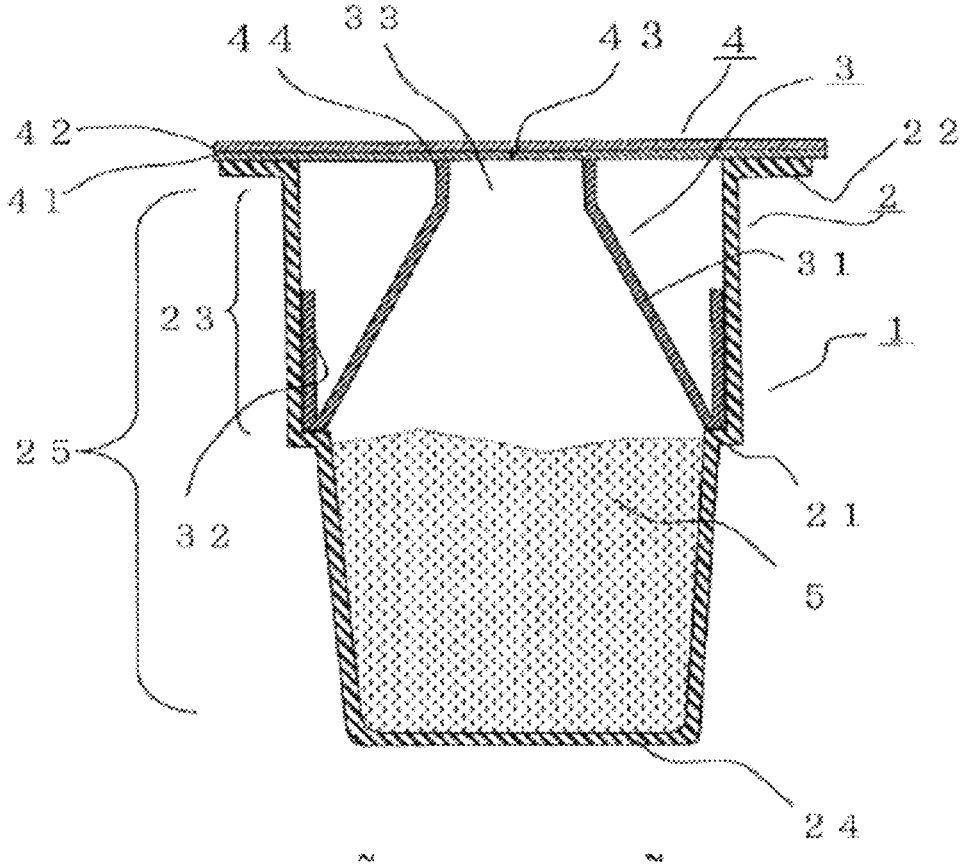
FIGS. 5A and 5B are a set of longitudinal sectional views of a packaging container according to a second embodiment of the present invention, and the longitudinal sectional views illustrate that the contents of the packaging container are being refilled into a storage container.
Figure 5B:
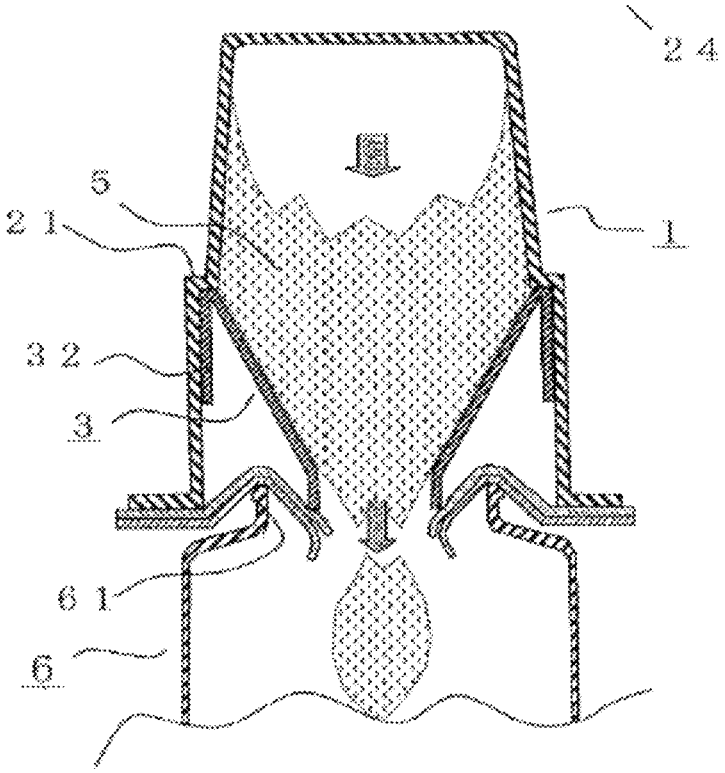

Hereinafter, a second embodiment of the present invention will be described. FIGS. 5A and 5B is a set of longitudinal sectional views of a packaging container 1 of the present invention, and the longitudinal sectional views illustrate that the contents of the packaging container 1 are refilled into a storage container 6. The view shown in FIG. 5A is a cross sectional view of a container body 2, a funnel part 3, a sealing lid 4 and contents 5 constituting the packaging container 1. The container body 2 includes a bottom portion 24, a body portion 25 which serves as a side wall connected to the peripheral edge of the bottom portion, and a flange 22 formed in a horizontal direction from the peripheral edge of the upper end of the body portion. Furthermore, the body portion 25 includes a funnel slide portion 23 having a uniform diameter at the upper body portion. The funnel slide portion 23 includes an abutment portion 21 at the lower end. In the example shown in FIG. 5A, the abutment portion 21 is configured by a stepped portion, however, it may be configured by a projection. The funnel slide portion 23 which is the upper body portion of the container body located at the upper side than the abutment portion 21 is provided such that the funnel part 3 is capable of sliding only along the funnel sliding portion 23, and stopping at any position.

The funnel part 3 includes a tapered side wall 31 having a frustum shape, a sliding wall 32 provided at the peripheral edge of a large opening diameter of the tapered wall, and a discharge opening 33 provided at the peripheral edge of a small opening diameter of the tapered side wall. The tip of the discharge opening 33 can be fused with the sealing lid 4, and it may be entirely fused, or circumferentially fused at some intervals. The inside of the tapered side wall 31 is desirably formed such that the contents can easily slide therealong with no resistance in order to be gathered to the center for discharging. The sliding wall 32 has a role of allowing the inner wall of the funnel slide portion 23 of the container body 2 to slide therealong, and has a required length for moving parallel without tilting the funnel part 3 during sliding. Further, the sliding wall 32 is configured to have the outer diameter slightly larger than the inner diameter of the funnel slide portion 23, to be stoppable at any position in the funnel slide portion 23. The discharge opening 33 provided at the peripheral edge of the small opening diameter of the tapered side wall 31 stores the contents inside the container by being partially fused with the inner surface of the sealing lid 4. The fusion strength therebetween is preferably set to be larger than the force required for sliding so as not to break the fusion when sliding the sliding wall 32.

The sealing lid 4 includes at least two or more layers of a lower layer film 41 and an upper layer film 42. The lower layer film 41 has roles of serving as a fusion layer for fusing the peripheral edge of the sealing lid with the flange 22 of the container body 2, and being easily torn when inserting an opening tip 61 of the storage container 6. The lower layer film 41 is formed by perforation processing, half cutting or the like as cut lines 43 for the purpose of being easily torn when inserting the opening tip 61 of the storage container 6. The upper layer film 42 is configured to be separable by adhering the peripheral edge and at least a part of the center of the upper layer film 42 to the lower layer film 41. When inserting the opening tip 61 of the storage container 6, this configuration allows the upper layer film 42 to be separated from the torn lower layer film 41 to easily deform the sealing lid due to a misalignment between the layers to thereby inserting the opening tip 61 of the storage container 6 to the inside of the opening portion of the container body 2. Further, the upper layer film 42 is simultaneously torn by the force by which the lower layer film 41 is torn along the cut lines 43 to thereby open the container.

The view show in FIG. 5B is a longitudinal cross sectional view of the packaging container 1, and the longitudinal sectional view illustrates that the packaging container 1 is pushed into the opening tip 61 of the storage container 6 for refilling. When the packaging container 1 is inverted for pushing the center of the sealing lid 4 into the opening tip 61 of the storage container 6, the lower end of the sliding wall 32 of the funnel part 3 collides with and is stopped at the abutment portion 21. Accordingly, since there is no other escape space for the sealing lid 4, the laminated upper layer film 42 of the sealing lid 4 is torn with the lower layer film 41 along the cut lines 43 by the pushing force. Immediately after tearing of the cut lines 43 of the sealing lid 4, the discharge opening 33 of the funnel part 3 of the packaging container 1 is inserted into the opening tip 61 of the storage container 6. At the same time, the opening tip 61 of the storage container 6 is inserted between the flange 22 of the packaging container 1 and the discharge opening 33 of the funnel part 3. Furthermore, the torn film of the sealing lid 4 is widely cut at the center thereof to be opened, and the cut sealing lid 4 is deformed along the opening tip 61 of the storage container 6 while the lower layer film 41 is separated from the upper layer film 42 to thereby open the center of the sealing lid 4. Hence, the contents 5 are reliably filled into to the storage container 6 without being spilled to the outside thereof.

When the upper layer film 42 can be easily separated from the lower layer film 41, and the lower layer film 41 is not provided with the cut lines at the entire surface thereof, refilling may be conducted after separating the upper layer film 42. In this case, the role of the upper layer film 42 is to protect the contents by imparting barrier properties, and to protect the lower layer film 41 having the cut lines.

Figure 6A:
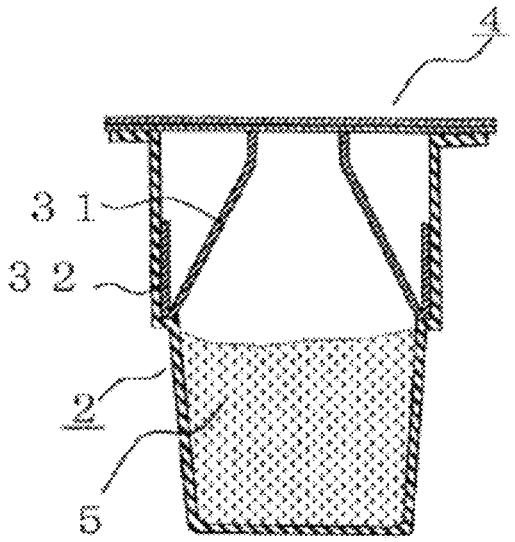
FIGS. 6A through 6D are a set of longitudinal sectional views of the packaging container according to the second embodiment of the present invention, and the longitudinal sectional views illustrate that the outer air pressure of the packaging container changes relative to the inner pressure of the packaging container.
Figure 6B:
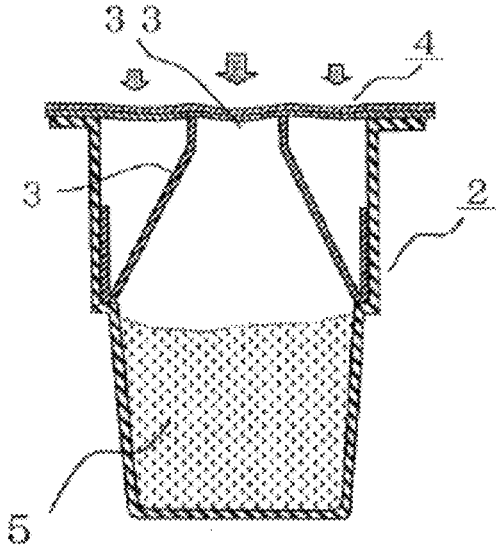
Figure 6C:
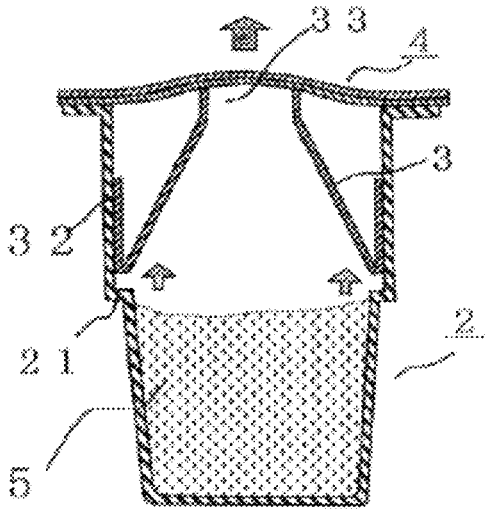
Figure 6D:
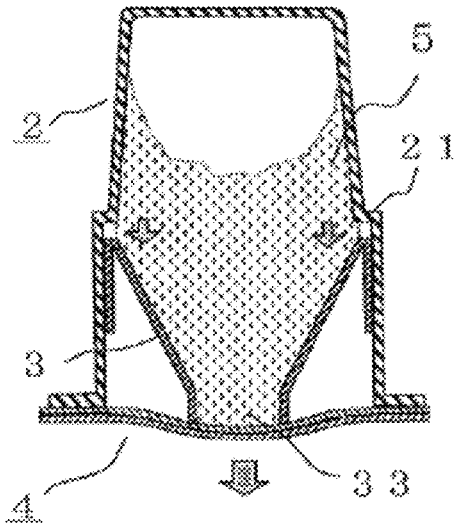

FIGS. 6A through 6D are a set of longitudinal sectional views of the packaging container 1, and the longitudinal sectional views illustrate that the external air pressure of the packaging container has changed relative to the internal pressure of the packaging container. The view shown in FIG. 6A is a cross sectional view of the container 1 in a normal state, and the cross sectional view illustrates that the internal air pressure of the packaging container 1 is the same as the external air pressure thereof, and the sealing lid 4 is an approximately flat surface. The view shown in FIG. 6B illustrates that the sealing lid 4 is pushed from the exterior of the packaging container 1 in the state that the external air pressure of the packaging container 1 is larger than the internal air pressure thereof. However, since the lower end of the funnel slide portion 23 collides with and stops at the abutment portion 21, the portions of the sealing lid 4 in which the flanges and the tip of the discharge opening 33 of the funnel part 3 are located are only slightly deformed without considerable deformation. The view shown in FIG. 6C illustrates that the packaging container 1 is under a low external air pressure, that is, such as on high mountains such as Mt. Fuji. or Mt Everest, or inside an aircraft. Under such a low air pressure, since the internal air pressure becomes relatively high, the packaging container 1 is bulged, thereby pushing the sealing lid 4 to the outside. In the packaging container 1 of the present invention, however, the funnel part 3 is not fixed to the container body 2 while the discharge opening 33 of the funnel part 3 is fused with the center of the sealing lid 4. Accordingly, the entire funnel part 3 is allowed to smoothly slide toward the outside. Therefore, the fused portion between the center of the sealing lid 4 and the discharge opening 33 of the funnel part 3 is prevented from being separated. The view shown in FIG. 6D illustrates that the packaging container 1 is turned upside down for refilling. Since the fused portion between the center of the sealing lid 4 and the discharge opening 33 of the funnel part 3 is not to be separated, the contents 5 are not spilled to the outside of the funnel part 3 even when in an upside-down state. When the packaging container 1 is turned upside down, the funnel part 3 moves downward, but this does not cause any problem because the funnel part 3 is pushed into the abutment portion 21 when the sealing lid 4 is pushed into the opening tip 61 of the storage container 6 during refilling.

Figure 11A:
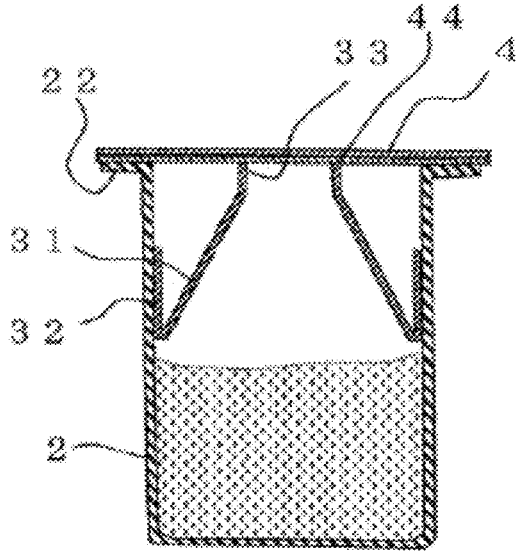
FIGS. 11A through 11D are a set of a longitudinal sectional view of the conventional packaging container, the longitudinal sectional views illustrating that the external air pressure of the packaging container has changed relative to the internal pressure of the packaging container.
Figure 11B:
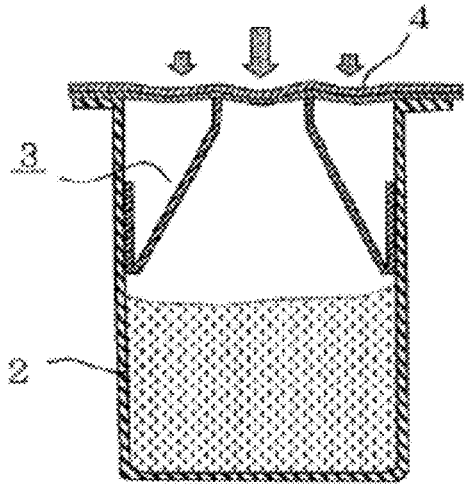
Figure 11C:
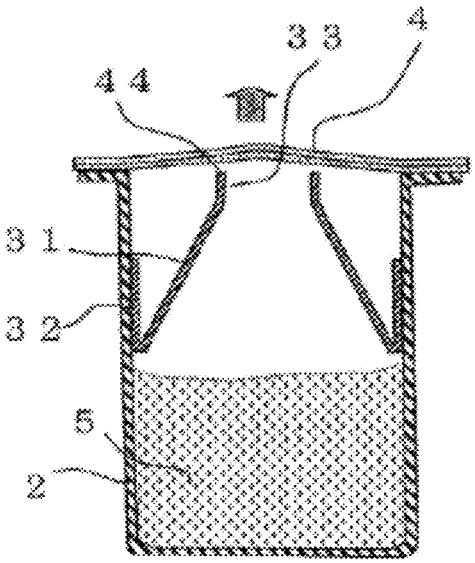
Figure 11D:
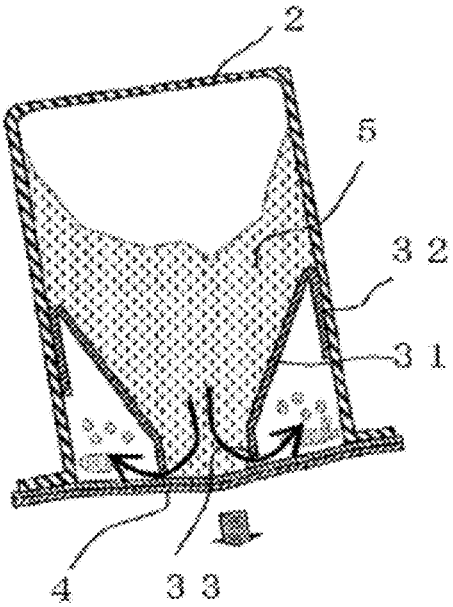

The view shown in FIG. 11A is a cross sectional view of a packaging container in which the funnel part 3 is fixed to the container body, and the sealing lid 4 is not fused with the discharge opening 33 for comparison with the present invention. In such a packaging container, since the sealing lid of the container is bulged outward due to the difference in air pressure between inside and outside the container when the packaging container is brought into places with low air pressure such as a high area or an aircraft in flight, the contents enter the gap between the outside of the funnel part and the sealing lid. Accordingly, the contents entering the gap are spilled outside the storage container during refilling, resulting in the problem that the contents cannot be fully refilled. As shown in FIG. 11B, the sealing lid at the periphery of the funnel part is only pushed inward when the external air pressure is high, whereas the sealing lid at the periphery of the funnel part is bulged outward when the external air pressure becomes low. Then, as shown in FIG. 11C, the sealing lid 4 is further bulged, and the sealing lid is separated from a fused portion 44 in which it is fused with the funnel part. The separation of the sealing lid from the fused portion 44 results in the problem that the contents 5 are spilled to the outside of the funnel part through a gap generated by the separation when the container vibrates during transport, or the container is turned upside down for refilling, as shown in FIG. 11D. Hence, refilling the contents to the container to be refilled includes problems such that the sealing lid is not evenly torn, or a large amount of contents 5 are spilled outside the packaging container.

Figure 7A:
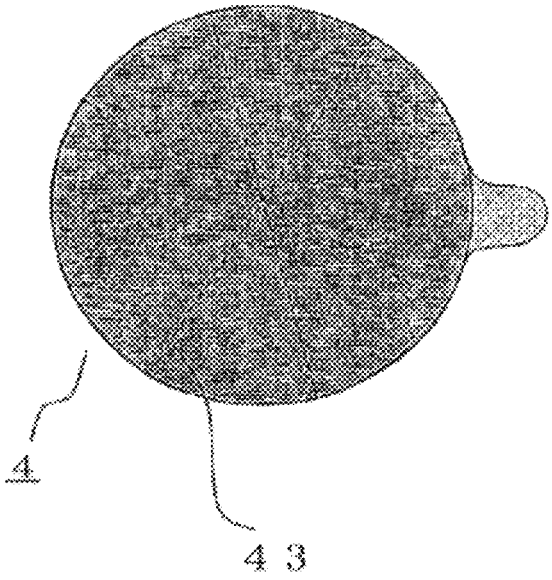
FIGS. 7A through 7E are a set of a plan view of an exemplary sealing lid used for the packaging container according to the second embodiment of the present invention, and longitudinal sectional views which schematically illustrate how the cross section of the sealing lid is to be torn.
Figure 7B:
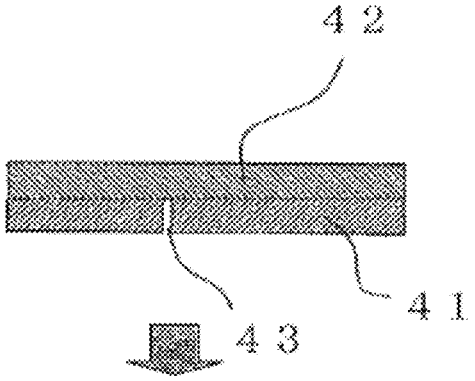
Figure 7C:
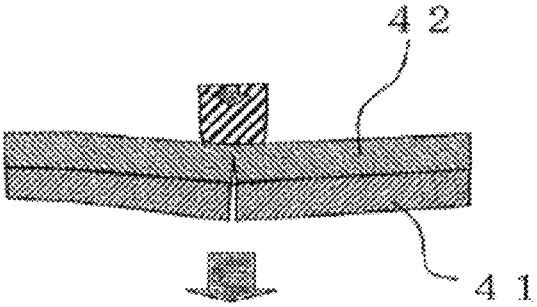
Figure 7D:
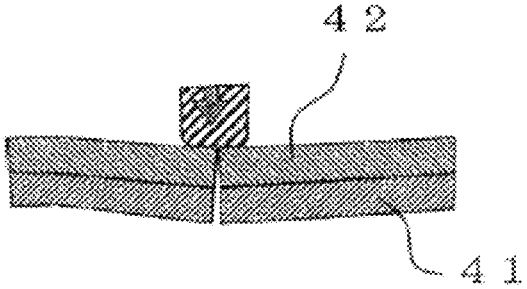
Figure 7E:
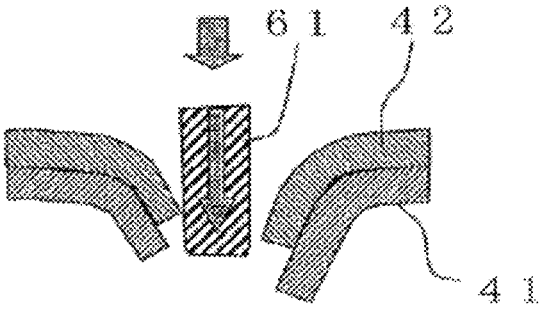

FIGS. 7A through 7E is a set of plan view of the exemplary sealing lid 4 according to the present embodiment, and longitudinal sectional views which schematically illustrate how the cross section of the sealing lid is to be torn. The view shown in FIG. 7A is a plan view of the sealing lid 4 provided with the cut lines 43 which radiate from the center. As shown in FIG. 7B illustrating the cross section, the cut lines 43 are formed by applying processing such as perforation, and formed on the lower layer film 41 while not being formed on the upper layer film 42. The views shown in FIGS. 7C through 7E illustrate that the sealing lid 4 is torn when it is pushed from the upper layer film 42 during refilling. The upper layer film 42 is also torn by following the cut lines 43 on the lower layer film 41. As the upper layer film 42 is torn, it is separated from the lower layer film 41, and more likely to be deformed.

Figure 8A:
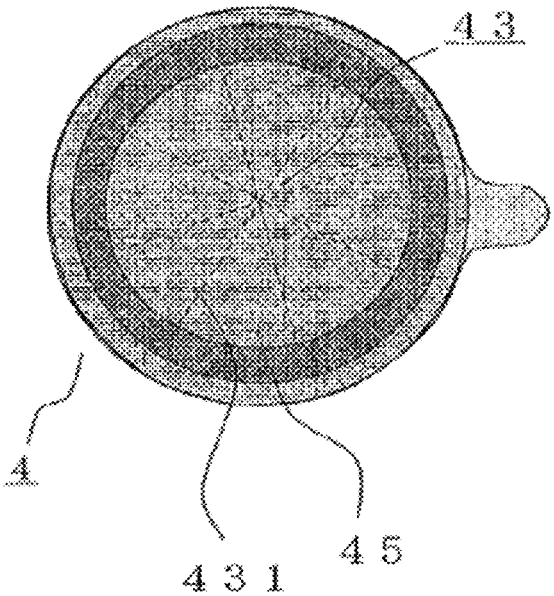
FIGS. 8A through 8E are a set of a plan view of another exemplary sealing lid used for the packaging container according to the second embodiment of the present invention, and longitudinal sectional views which schematically illustrate how the cross section of the sealing lid is to be torn.
Figure 8B:
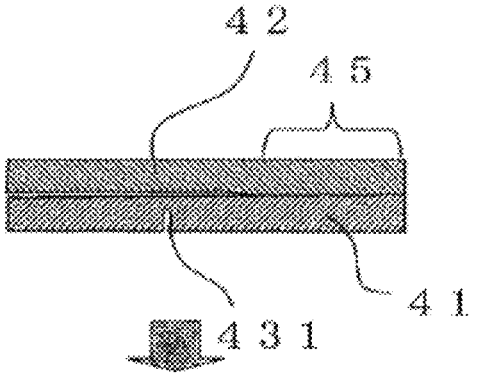
Figure 8C:
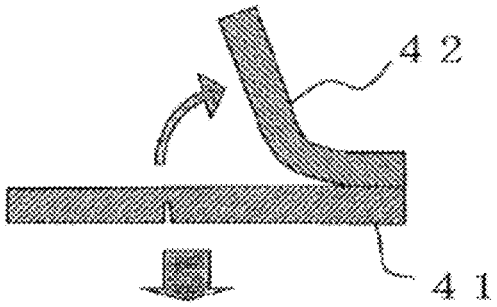
Figure 8D:
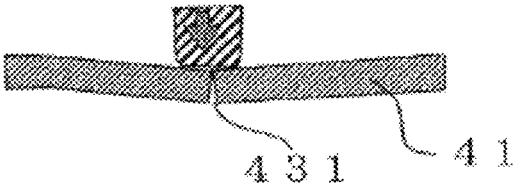
Figure 8E:
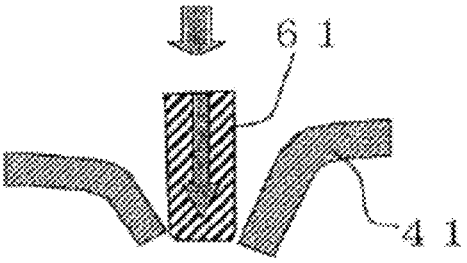

FIGS. 8A through 8E are a set of a plan view of another exemplary sealing lid 4 according to the present embodiment, and longitudinal sectional views which schematically illustrate how the cross section of the sealing lid 4 is to be torn. The view shown in FIG. 8A is a plan view of the sealing lid 4 provided with the cut lines 431 which radiate from the center. These cut lines 431 are formed by applying processing such as perforation, however, the processing is only applied for the center which does not include an adhesive region 45 between the upper layer film 42 and the lower layer film 41. The adhesive region 45 is not necessarily in a doughnut shape as shown in FIG. 8A, unless the cut lines 43 are not included. As shown in FIG. 8B illustrating the cross section, weakened lines 431 are formed on the lower layer film 41 such that the lower layer film 41 is partially torn through the thickness thereof, while not being formed on the upper layer film 42. The upper layer film 42 has a surface laminated with an easy peel film on a side to be adhered to the lower layer film 41, the easy peel film having low adhesiveness being laminated so as not to affect the weakened lines 431 of the lower layer film 41. Accordingly, the upper layer film 42 can be separated from the lower layer film 41. As shown in FIG. 8C, the upper layer film 42 is separated. The views shown in FIGS. 8D and 8E illustrate that the sealing lid 4 is pressed to be torn during subsequent refilling. That is, the weakened lines 431 are broken as shown in FIG. 5-4, and then the sealing lid 4 is torn when it is completely pushed into the opening tip 61 of the storage container from the upper side as shown in FIG. 8E. As the lower layer film 41 is torn throughout the entire thickness thereof by following the cut lines 43 of the sealant layer and is remarkably torn, the torn portion of the lower layer film 41 is increased.

Figure 9:
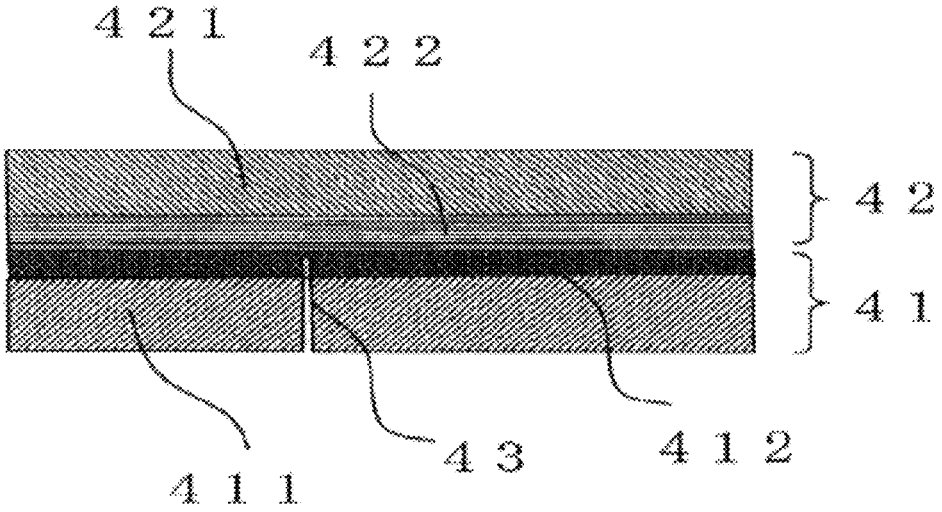
FIG. 9 is a schematic cross sectional view of an exemplary laminated sheet constituting the sealing lid according to the second embodiment of the present invention.
Figure 10:
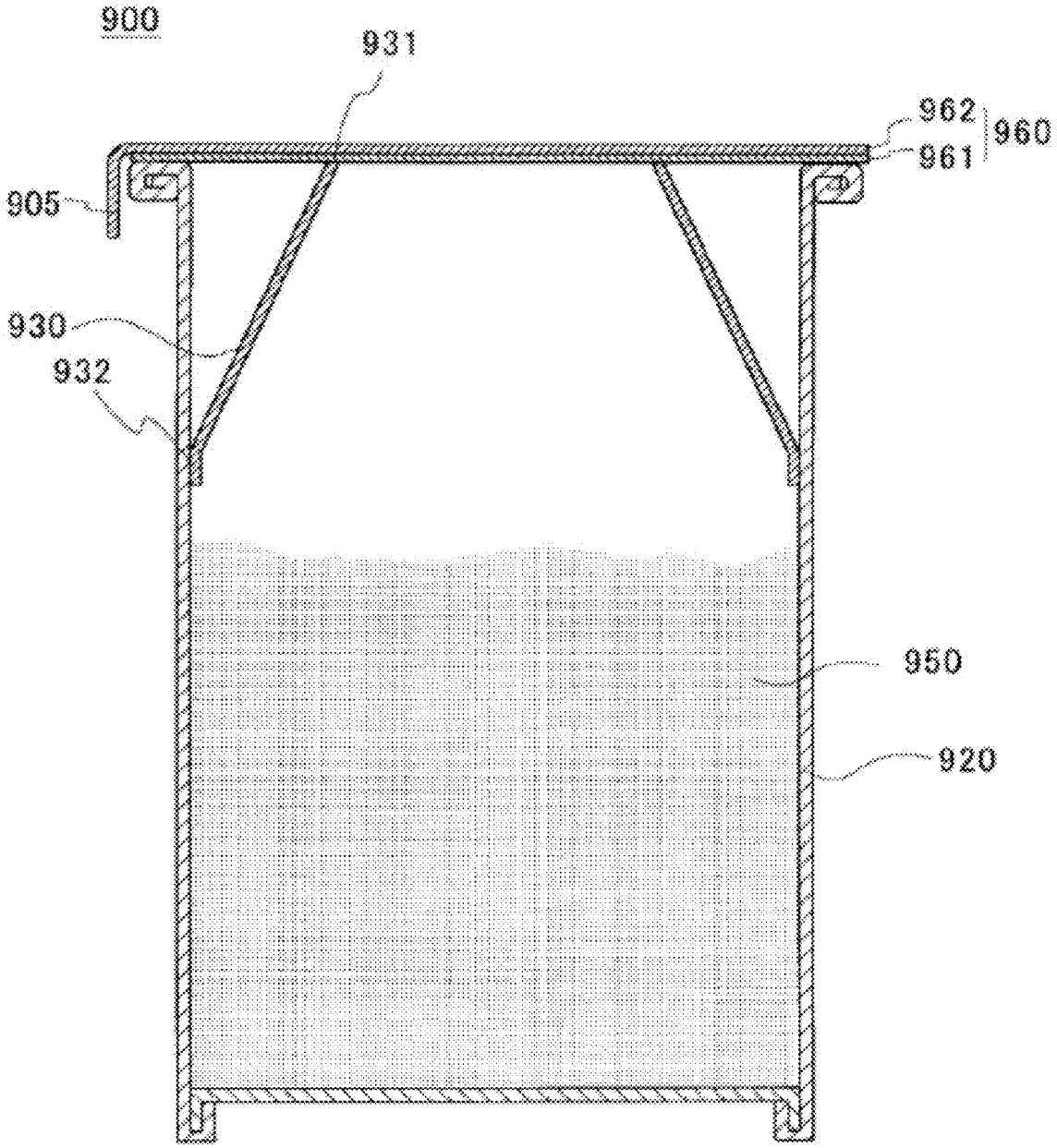
FIG. 10 is a longitudinal sectional view of a conventional packaging container.

FIG. 9 is a schematic cross sectional view of an exemplary laminated sheet which constitutes the sealing lid 4. In the example shown in FIG. 9, a laminated film including a barrier film 421 and an easy peel film 422 is used as the upper layer film 42, and a laminated film including a polyethylene terephthalate film 412 and a polyethylene film which is a sealant layer 411 is used as the lower layer film 41. The lower layer film 41 includes a perforation thereon as the cut lines 43. Hence, when the perforation is strongly pushed by a container mouth, the upper layer film 42 is also easily torn, thereby allowing the container to be opened. Further, the upper layer film 42 includes the easy peel film 422 on the inner side. Accordingly, the upper layer film 42 is separated from the lower layer film 41 when they become misaligned at the boundary therebetween, followed by conforming to the shape of the opening tip of the container to be refilled which is pushed into the lower layer film 41. Therefore, the contents are prevented from being spilled in the vicinity of the opening tip. These laminated sheets are manufactured by manufacturing a laminated film using a dry laminating machine, an extruder laminating machine or the like, followed by punching the laminated film using a punching die. Further, the sealing lid 4 may be provided with an over cap thereon cap thereon to protect against dirt and tearing during transport.

In the laminated sheet of which the upper layer film 42 is firstly peeled off for opening, the laminated film of the barrier film 421 and the easy peel film 422 having low adhesiveness are used as the upper layer film 42. Further, the laminated film of the polyethylene terephthalate film 412 and the polyethylene film which serves as the sealant layer 411 are used as the lower layer film 41. The lower layer film 41 includes a perforation thereon as the cut lines 43. The upper layer film 42 includes the easy peel film 422 having low tackiness, thereby allowing easy separation from the lower layer film 41. Accordingly, the cut lines 43 of the lower layer film 41 can be prevented from being dragged and broken when the upper layer film 42 is separated from the lower layer film 41, or the lower layer film 41 can be prevented from being torn due to vibration during transport. When the upper layer film 42 is separated, the container is covered only with the lower layer film 41. Accordingly, when a container mouth is pushed onto the cut lines 43, the lower layer film 41 is easily torn so as to open the container. In this example, since the upper layer film 42 can be formed so as to be durable while having high barrier properties, storage performance can be improved while minimizing degradation of the contents. This lid material can also be manufactured by manufacturing a laminated film using a dry laminating machine, an extruder laminating machine or the like, and then partially heat-sealing the laminated film, followed by punching the laminated film using a punching die. The patterns of non-adhesive regions on the upper layer film and the lower layer film are laminated after being printed and processed on the films in advance, however, they may be laminated by printing the pattern of the adhesive region with adhesive agents.

For the easy peel film, resin dispersion film in a micellar state is preferably used, in which olefin resin is kneaded with resin having low fusing properties relative to the material of the lower layer film such as styrene resin, acrylic acid ester, vinyl acetate resin, phthalic anhydride modified polyolefin or other olefin resin. Alternatively, polyester-based materials may be used. The film having a low adhesiveness can be easily adjusted by reducing the ratio of olefin resin, or the like.

The sealant layer 411 may be formed of linear low density polyethylene, high pressure low density polyethylene, or a material to which ethylene and vinyl acetate copolymer, low polymerization resin or the like is added for ease of fusion at low temperature. Further, the polyethylene terephthalate film 412 is biaxially stretched, however, it may be a biaxially stretched polypropylene film or the like.

The container body 2 used for the packaging container 1 of the present embodiment can be manufactured using injection molding, blow molding, vacuum/pressure molding or the like. The material can include a variety of molding resins such as an olefin resin such as polypropylene, polyethylene, polymethylpentene or cyclic polyolefin resin, a styrene resin such as styrene-acrylonitrile copolymer resin, acrylonitrile-butadiene-styrene copolymer resin or polystyrene resin, an acrylonitrile resin or a polyphenylene resin. The abutment portion 21 may be formed by an inner slide structure (collapsible core) with a rib provided on the inner surface of the container body 2, or may be partially butted so as to be an inclined pin except for being formed in the stepped portion. Further, the container body 2 may be formed not by a plastic, but pulp molding. In this case, hot melted adhesive agents or the like are preferably used instead of the sealant layer of the sealing lid 4.

As with the container body 2, the funnel part 3 used for the packaging container 1 of the present embodiment may be manufactured using injection molding, blow molding, vacuum/pressure molding or the like. The material can include a variety of molding resins such as an olefin resin such as polypropylene, polyethylene, polymethylpentene or cyclic polyolefin resin, styrene resin such as styrene-acrylonitrile copolymer resin, acrylonitrile-butadiene-styrene copolymer resin or polystyrene resin, acrylonitrile resin or polyphenylene resin. Further, the material in which resin such as polyethylene is laminated onto the both surfaces of the paper of the substrate may be used for shaping by conducting punching, folding and laminating. Basically, the outer surface of the sliding wall 32 is preferably made of a material different from that of the container body 2 to impart slidability.

The packaging container 1 of the present embodiment is a secure container capable of reliable refilling without problems such that the contents are spilled outside a storage container during refilling, even if it is used as a packaging container when refilling at a place of a high altitude such as a mountain lodge or a ski site, exporting overseas or air transporting to isolated islands. In addition, since the packaging container 1 has a high productivity, and is stably produced, non-defective product ratio is improved, and the cost is reduced. Accordingly, the present invention has large advantageous effects.

According to the above embodiments, when the funnel part is attached to the container body, it does not move to the position at least closer to the bottom portion than to the predetermined position, thereby facilitating positioning. Accordingly, the manufacturing cost can be reduced. Furthermore, in the packaging container according to the second embodiment, the funnel part is more likely to follow the bulge of the sealing lid due to sliding of the sliding wall even under a low external air pressure. Accordingly, the contents are less likely to enter the gap of the fused portion between the sealing lid and the funnel. Therefore, the whole amount of the contents can be smoothly refilled into the storage container without being spilled outside the storage container during refilling.

The present invention can be implemented by appropriately interchanging the components of the above embodiments, or appropriately changing and omitting the features of the components. Further, the aspect of the engagement mechanism is not limited, and it can be variously implemented if the movement of the funnel part can be restricted by the interference between the wide opening end of the funnel part and the engagement mechanism provided at the predetermined position of the container body.

INDUSTRIAL APPLICABILITY

The present invention is useful for packaging containers or the like for transferring of the fluid substances such as powdered, granular or liquid substances into other containers.

REFERENCE SIGNS LIST

100, 900: Packaging container; 105: Tab; 120, 920: Container body; 121: Bottom portion; 122: Body portion; 123: Engaging groove; 130, 930: Funnel part; 131, 931: Narrow opening end; 132, 931: Wide opening end; 133: Projection; 134: Engaging portion; 150, 950: Contents; 160, 960: Sealing lid; 161: Lower layer film; 162: Upper layer film; 199: Cut lines; 1: Packaging container; 2: Container body; 21: Abutment portion; 22: Flange; 23: Funnel slide portion; 24: bottom portion; 25: Body portion; 3: Funnel part; 31: Tapered side wall; 32: Sliding wall; 33: Discharge opening; 4: Sealing lid; 41: Lower layer film; 411: Sealant layer; 412: Polyethylene terephthalate film; 42: Upper layer film; 421: Barrier film; 422: Easy peel film; 43: Weakened portion; 431: Weakened lines; 44: Fused portion; 45: Adhesive region; 5: Contents; 6: Storage container; 61: Opening tip

What is claimed is:

1. A packaging container comprising:

(A) a container body comprising a body portion, a bottom portion at a first end of the body portion and an opening at a second end of portion, the body portion has a tapered shape, in which a diameter is gradually increasing from the first end to the second end of the body portion, the body portion comprises an engaging groove extending outwards from an inner volume of the container body;

(B) a funnel part having a funnel shape, the funnel part has an narrow opening end and a wide opening end, the funnel part is inserted into the inner volume of the container body, and the wide opening end of the funnel part is restricted from moving toward the first end of the body portion by the engaging groove; and (C) a sealing lid sealed to the opening portion of the container body while being in contact with the narrow opening end of the funnel part to seal the container body, wherein the funnel part comprises an engaging portion at the wide opening end thereof, the engaging portion comprises a projection extending outwards from an inner volume of the funnel part, the projection of the engaging portion is engaged with the engaging groove to further restrict the wide opening end of the funnel part from moving toward the second end of the body portion.

2. The packaging container of claim 1, wherein the engaging portion comprises a tapered portion, which is surface contact with the tapered shape of the body portion when the projection of the engaging portion is engaged with the engaging groove of the body portion.

3. The packaging container of claim 1, wherein at least a part of the engaging portion is welded to an inner surface of the body portion.

4. A method of manufacturing the packaging container of claim 3, the method comprising:

a step of heating the engaging groove and the engaging portion in advance;

a step of inserting the funnel part from the wide opening side thereof into the inner volume of the container body through the opening portion of the body portion; and a step of engaging and adhering the projection of the engaging portion to the engaging groove for fixing.

5. A method of manufacturing the packaging container of claim 3, the method comprising:

a step of inserting the funnel part from the wide opening side thereof into the body container through the opening portion of the body portion;

a step of engaging the projection of the engaging portion with the engaging groove; and a step of heating and adhering the engaging portion in a state of being engaged with the engaging groove for fixing.

6. The packaging container of claim 1, wherein the sealing lid includes an easy peel film on an inner surface of the packaging container.

* * * * *